US005947371A

United States Patent [19]

Lee

[11] Patent Number: 5,947,371

[45] Date of Patent: Sep. 7, 1999

[54] OPERATION CONTROL APPARATUS OF AN AIR CONDITIONER AND A METHOD THEREOF

[75] Inventor: Seung-Kwan Lee, Suwon, Rep. of Korea

[73] Assignee: Samsung Electronics Co., Ltd., Kyungki-do, Rep. of Korea

[21] Appl. No.: 09/200,234

[22] Filed: Nov. 25, 1998

[30] Foreign Application Priority Data

Nov. 28, 1997 [KR] Rep. of Korea ..... 97-63922

[51] Int. Cl.[6] ..... F24F 7/00

[52] U.S. Cl. ..... 236/49.3; 62/161; 62/180; 62/186; 454/258

[58] Field of Search ..... 236/49.3, 51, 91 R, 236/91 D, 91 F; 165/243; 454/256, 258, 284, 285; 62/177, 178, 179, 180, 186, 160, 161, 163, 164

[56] References Cited

U.S. PATENT DOCUMENTS 4,738,116 4/1988 Himeno et al. ..... 236/49.3 X
4,807,444 2/1989 Aoki et al. ..... 62/186 X
5,251,814 10/1993 Warashima et al. ..... 454/258 X
5,875,639 3/1999 Kim et al. ..... 62/186

*Primary Examiner*—Harry B. Tanner
*Attorney, Agent, or Firm*—Burns, Doane, Swecker & Mathis, L.L.P.

[57] ABSTRACT

A room air conditioner is operable to perform heating or cooling operations in a room. Furthermore, it is possible to direct warm or cool air to selected regions of the room. For example, it is possible to carry out a distant mode of operation wherein warm or cool air is supplied to a distant region of the room, or a wide mode wherein the warm or cool air is directed across the entire width of the room. When either the distant mode or the wide mode is selected, a control mechanism of the air conditioner automatically resets the set temperature by either raising or lowering a fixed reference temperature (pre-programmed into the air conditioner controller). If a heating operation has been selected, the reference temperature is automatically increased by a predetermined amount, and during a cooling operation, the reference temperature is automatically reduced by a predetermined amount.

4 Claims, 6 Drawing Sheets

OPERATION CONTROL APPARATUS OF AN AIR CONDITIONER AND A METHOD THEREOF

FIELD OF THE INVENTION

The present invention relates to an air conditioner which selectively carries out a cooling of a distant area of a room or a wide area of a room by regulating the discharged air flow directions.

DESCRIPTION OF THE PRIOR ART

A prior art air conditioner includes a heating apparatus for supplying hot air by heating cold room air and a cooling apparatus for supplying cold air by cooling warm room air. Besides, a heating and cooling air conditioner is also marketed for a dual function of heating and cooling operations with an additional air purifying function being included for cleaning the polluted room air.

FIG. 1 illustrates an indoor unit of the heating and cooling air conditioner. The cooling and heating air conditioner also has an outdoor unit (not shown).

As shown in FIG. 1, reference numeral 1 is an indoor unit of the air conditioner. The indoor unit 1 is provided at an upper front surface thereof with a plurality of suction inlets 3 to admit room air and with a plurality of discharge outlets 5 at a lower front surface thereof to discharge indoors the heat-exchanged air, i.e., the heated or cooled air, that is sucked through the suction inlets 3.

Furthermore, a remotely controlled signal receiving unit 7 is provided at one right side of the discharge outlets 5 for receiving a remotely controlled signal sent from the remote controller 9. The discharge outlets 5 comprise horizontal vanes 11 and vertical vanes 13 for respectively controlling the vertical and horizontal directions of the air discharged indoors therethrough.

On the other hand, the remote controller 9 includes a plurality of operational keys for selecting a start/stop of the air conditioner, selecting a set (target) temperature for the room, selecting a desired operation mode among auto, cooling, heating, dehumidify, air-cleaning and so forth, for adjusting the amount or flow directions of strong, mild or light air, etc., for controlling room temperature, and a plurality of timer mode keys for indicating a current time of day, for setting a time to start or stop the operation of the air conditioner.

FIG. 2 is a longitudinal sectional view of the indoor unit which is installed on a wall. Throughout the drawings, like reference numerals and symbols are used for designation of like or equivalent parts or portions for simplicity of illustration and explanation, and redundant references will be omitted.

As shown in FIG. 2, the indoor unit is provided with a refrigerant-conducting heat-exchanger 15 behind the suction inlets 3 for heat-exchanging the room air sucked through the suction inlets 3 into cold or hot air by way of the evaporative latent heat of a coolant. An indoor fan 17 is mounted behind a lower portion of the heat-exchanger 15 for sucking room air through the suction inlets 3 and simultaneously for discharging the heat-exchanged air through the discharge outlets 5.

A duct member 19 is installed for guiding the air flow from the suction inlets 3 to the discharge outlets 5. Reference numeral 21 indicates an evaporated water dish.

The air conditioner thus constructed starts to be operative as a user depresses the start/stop key (hereinafter referred to as an operation key) by manipulating the remote controller 9 and as the user sets a desired operation mode (for example, cooling or heating) and a set (desired) room temperature. The remotely controlled signal relating to the key inputs is encoded by a predetermined protocol and converted to an ultraviolet signal.

As the ultraviolet signal is transmitted from the remote controller 9, the signal is received by the remotely controlled signal receiving unit 7, converted into an electrical signal, and subsequently demodulated to start an operation of the indoor unit 1.

At this time, the temperature sensor (not shown) detects a room temperature around the indoor unit 1. Then, the indoor unit determines an operation frequency of a compressor 109 depending on the difference between the set room temperature and the detected room temperature to drive the compressor.

If the compressor is driven, the room air sucked into the indoor unit 1 is heat-exchanged into cold or hot air by way of the evaporative latent heat of the coolant in the course of passing the heat-exchanger 15, is guided by the duct member 19, and then is discharged through the discharge outlets 5. Then, the discharged air carries out a room-cooling or room-heating operation as it is blown at the air flow angles of the blades 11 and 13.

If a distant conditioning key or a wide conditioning key is depressed during one of the operating modes such as automatic, cooling, heating, dehumidifying, blowing, etc. by using the remote controller, then a control unit in the air conditioner automatically resets the room temperature by subtracting 1 degree Celsius from a predetermined reference temperature (Tf) that is pre-programmed in the control means during manufacture of the air conditioner. For example, if the reference temperature (Tf) is 25° C., then the control means automatically resets the room temperature to 24° C. if the wide key or distant key is depressed.

When the ultraviolet signal is sent from the remote controller 9, the remote controller receiving unit 7 of the indoor unit 1 receives the signal and compares it to the detected room temperature to drive the compressor according to the difference between the reset temperature (i.e., the reference temperature (Tf) minus 1 degree Celsius) and the detected room temperature (Tr). At the same time, the air blades 11, 13 are adjusted at air flow angles for the respective operation mode. That is, the air blades are controlled to direct air to the distant places of a room for the distant conditioning, or they are controlled to direct air across the room for the wide conditioning.

If the distant or wide conditioning key is depressed twice, the air conditioner returns to a general operation prior to performing the distant or wide conditioning.

There is a shortcoming involving such an air conditioner. That is, since both the heating operation and the cooling operation are performed in accordance with a reset temperature (Trs) that is determined by subtracting 1° C. from a reference temperature (Tf), the cooling operation will be more intense than the heating operation for respective distant and wide conditioning, as shown in FIG. 3.

SUMMARY OF THE INVENTION

The present invention is presented to solve the aforementioned problems and it is an object of the present invention to provide an operation control apparatus of an air conditioner and a method thereof for establishing a reset temperature (Trs) when a distant mode or a wide mode is selected, in a heating operation as well as in a cooling operation.

In order to achieve the object of the present invention, there is provided an operation control apparatus of an air conditioner which comprises an air inlet for admitting air from a room, a heat exchanger for selectively heating and cooling the admitted air, an air outlet for discharging the heated air or cooled air, and a fan for sequentially circulating air through the inlet, the heat exchanger, and the outlet. An adjustable air direction regulating mechanism is provided for regulating a direction of air discharge from the outlet during modes of operation of the air conditioner including a distant mode wherein air is discharged to a distant region of the room, and a wide mode wherein air is discharged across an entire width of a room. An input device is provided for enabling a user to select between the modes of operation, and for selecting a set room temperature. A control mechanism is provided which is connected to the heat exchanger, the fan, the input device, and the regulating mechanism for operating the heat exchanger to achieve the set temperature. The control mechanism is operable, in response to a selection of either of the distant mode or the wide mode, to reset the set temperature to a reset temperature equal to a reference temperature which is raised by a predetermined increment during a heating mode or lowered by a predetermined increment during a cooling mode.

A method aspect of the invention comprises selecting between a cooling operation and a heating operation, and also selecting between modes of operation including a distant mode wherein an air direction regulating mechanism causes air to be discharged to a distant region of the room, and a wide mode wherein the air direction regulating mechanism causes the air to be discharged across an entire width of a room. A room air temperature is detected. A reset temperature is automatically established in response to the distant mode or the wide mode being selected. During a heating operation the reset temperature equals a reference temperature raised by a predetermined increment. During a cooling operation the reset temperature equals the reference temperature lowered by a predetermined increment. Room air is conducted across a heat exchanger to change the temperature of the room air in accordance with a difference between the reset temperature and the detected room temperature. The room air is discharged back into the room in the appropriate direction.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

Figure 1:
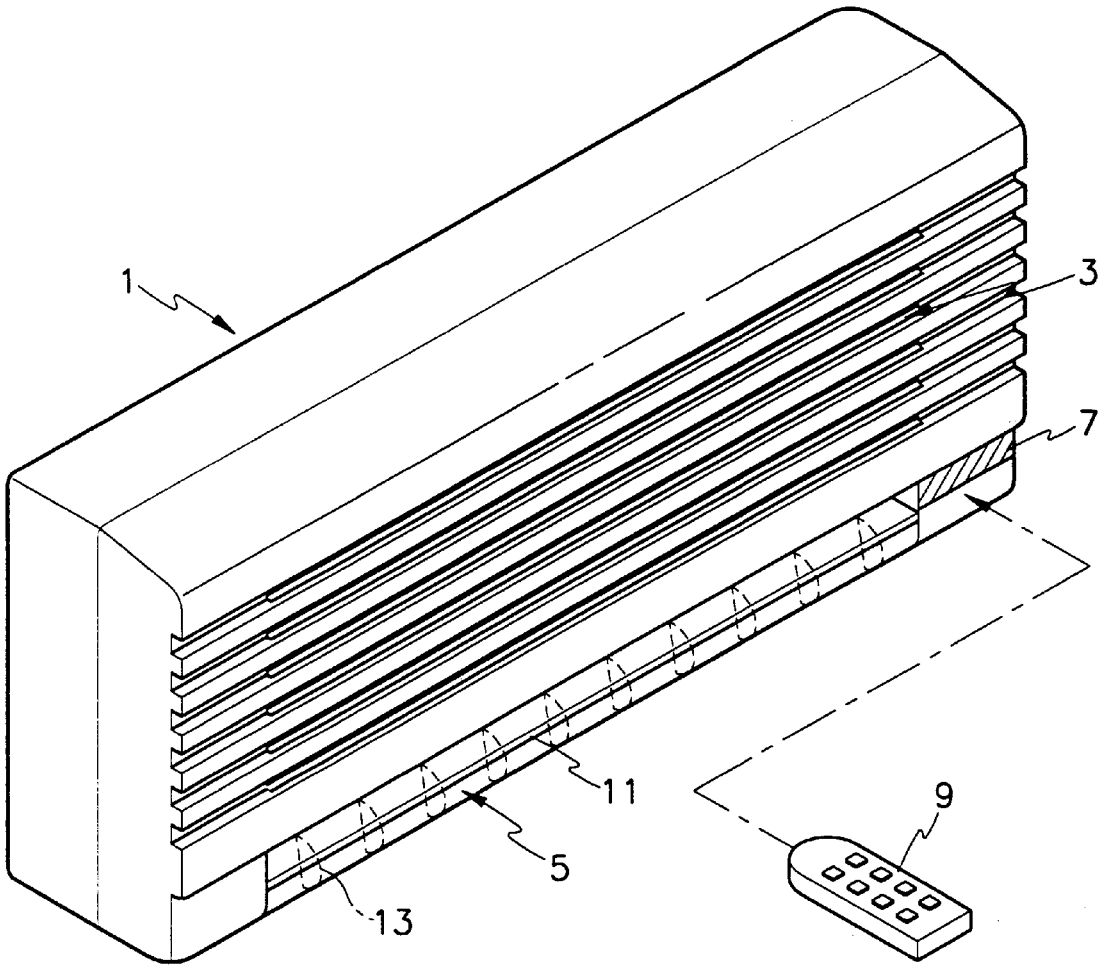
FIG. 1 (PRIOR ART)
FIG. 1 is a front perspective view for illustrating an indoor unit of a conventional air conditioner.
Figure 2:
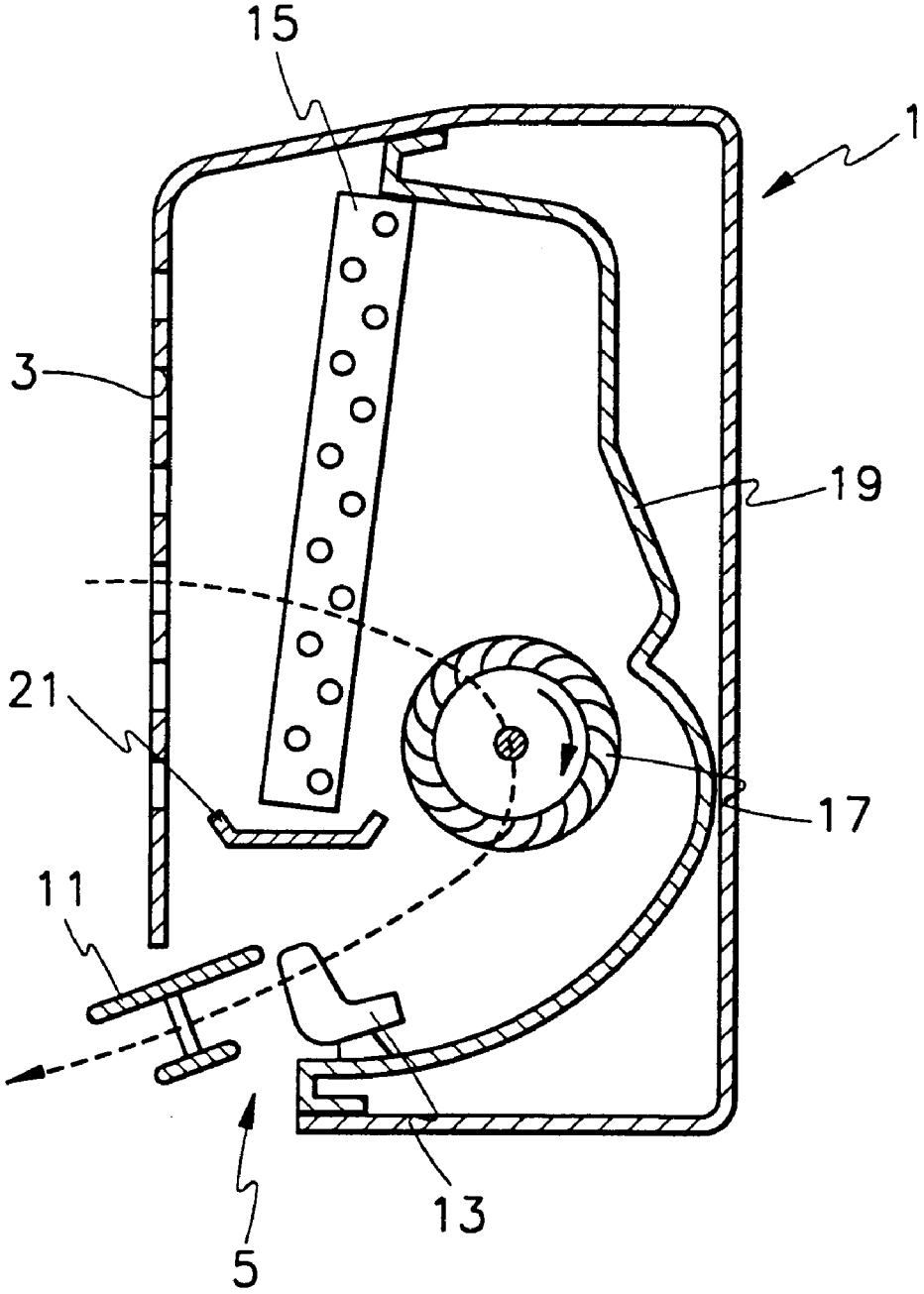
FIG. 2 (PRIOR ART)
FIG. 2 is a vertical sectional view of the indoor unit of FIG. 1, the unit being installed on the wall.
Figure 3:
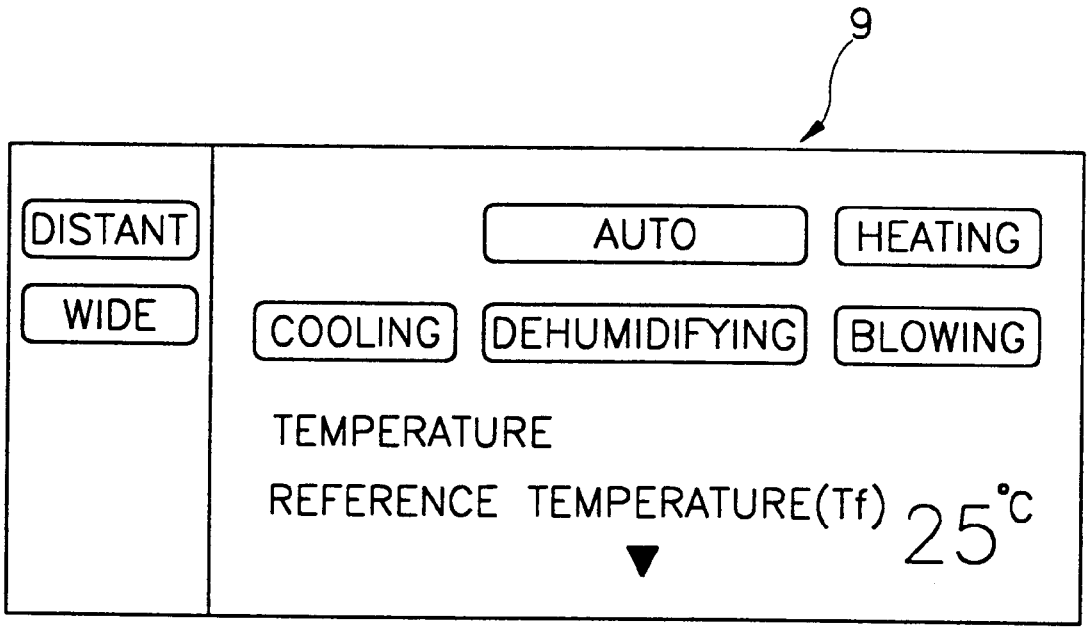
FIG. 3 (PRIOR ART)
FIG. 3 shows a conventional remote controller.

A preferred embodiment of the present invention is described in detail with reference to the accompanying drawings. Throughout the drawings, like reference numerals and symbols in FIGS. 1 and 2 are used for the designation of like or equivalent parts or portions for simplicity of illustration and explanation, and redundant references will be omitted.

Figure 4:
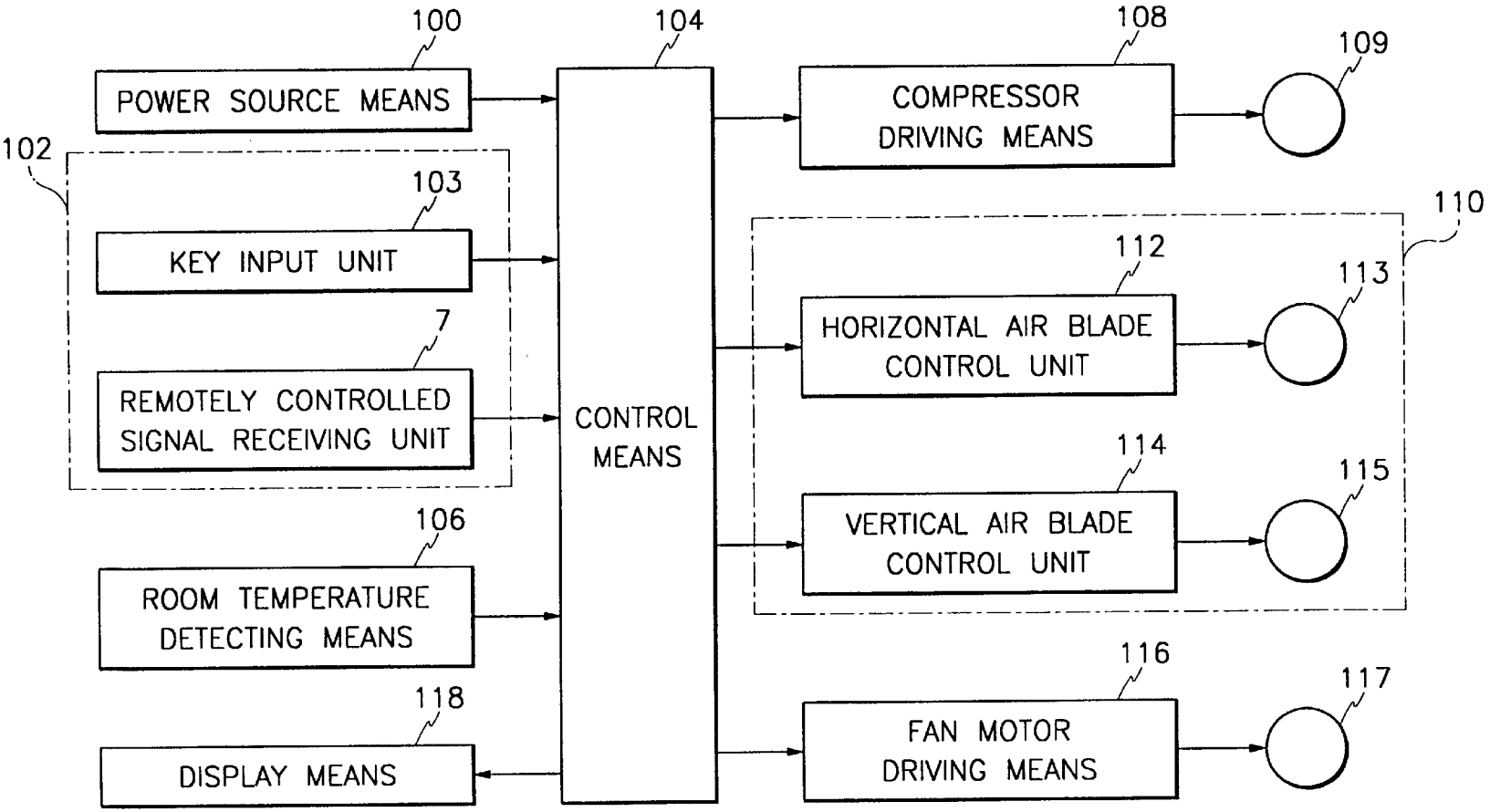
FIG. 4 is a schematic block diagram for illustrating an operation control apparatus in accordance with an embodiment of the present invention.
Figure 5:
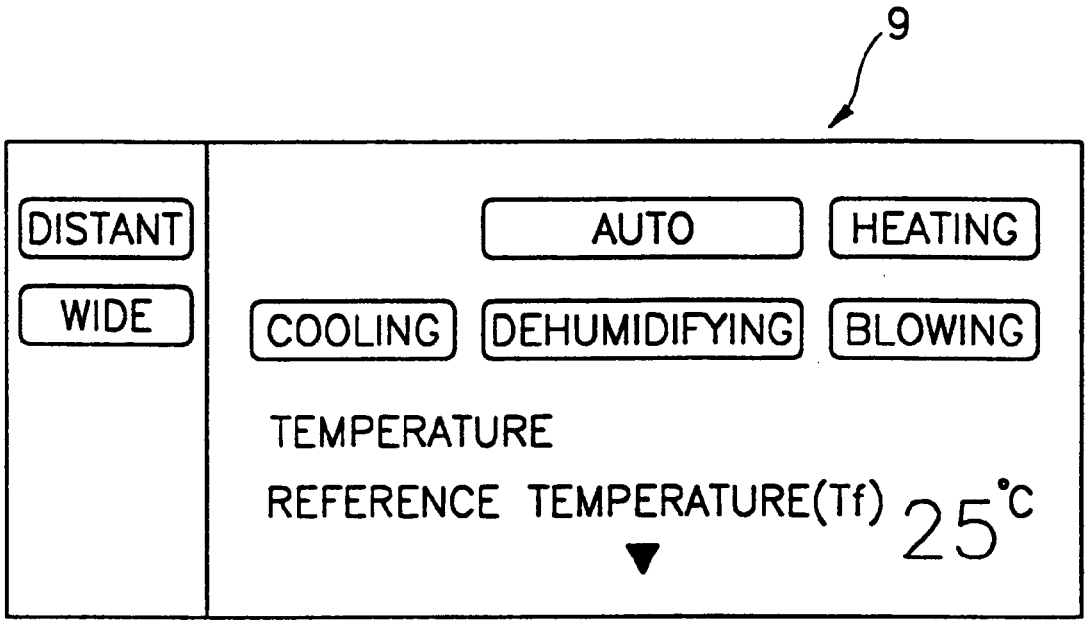
FIG. 5 shows a remote controller at a cooling operation in accordance with the present invention.
Figure 6:
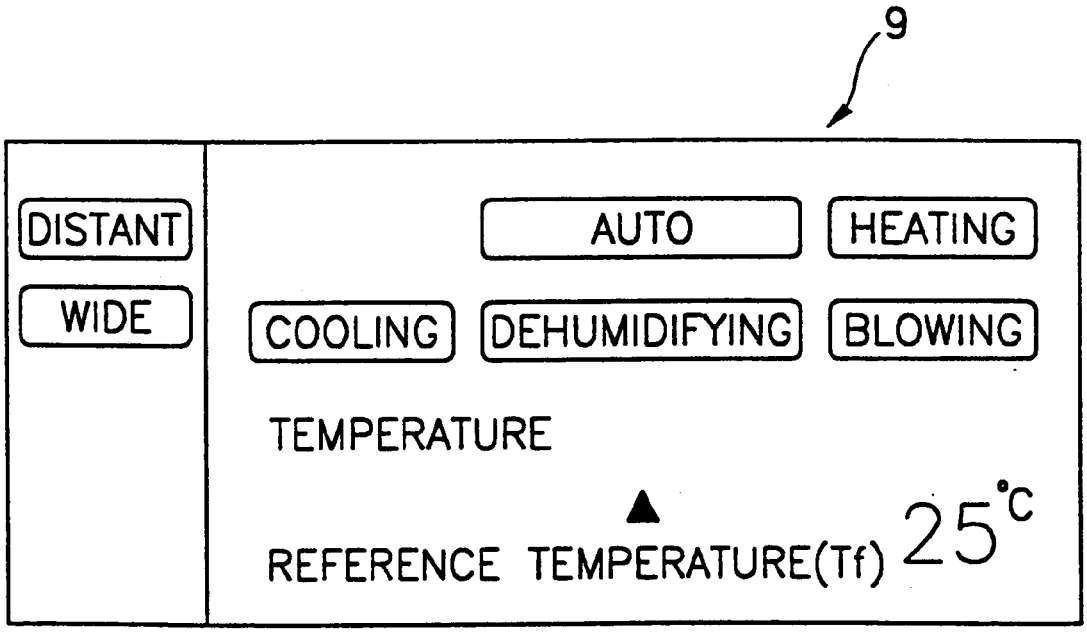
FIG. 6 shows a remote controller at a heating operation in accordance with the present invention.

As shown in FIG. 4, power source means 100 is provided to convert commercial alternating current voltage supplied from the alternating current power terminal (not shown) into the predetermined direct current voltage. Operation manipulating means 102 comprises a plurality of function keys for all operation modes (auto, cooling dehumidifying, blowing, heating and the like), for an amount (strong air, weak air, or soft air) of discharged air, and for a distant conditioning operation and a wide conditioning operation where the air flow directions of the discharged air are automatically controlled to direct the air respectively to the distant places of a room (distant operation) and across the width of the room (wide operation). The operation manipulating means 102 includes a key input part 103 on the operation panel of the indoor unit 1 and a remotely controlled signal receiving unit 7 for receiving the ultraviolet signal sent from the remote controller 9.

A control means 104 is a microcomputer to initialize the air conditioner and to control overall operations of the air conditioner according to the operation signal sent from the operation manipulating means 102.

Room temperature detecting means 106 detects the temperature (Tr) of the room air sucked through the suction inlets 3. Compressor driving means 108 receives a control signal sent from the control means 104 according to the difference between: (a) a set temperature (Ts) set by manipulating the operation manipulating means 102, and (b) a detected room temperature (Tr) detected by the room temperature detecting means 106, to thereby drive the compressor 109.

Air direction controlling means 110 controls the vertical and horizontal directions of the air discharged through the discharged outlets 5. The air direction controlling means 110 includes a horizontal air blade control unit 112 for driving the motor 113 to move the horizontal air blades 11 as a pulse signal is input from the control means 104, and a vertical air blade control unit 114 for driving the motor 115 to move the vertical air blades 13 as a pulse signal is input from the control means 104.

Fan motor driving means 116 controls an indoor fan 17 by controlling the speed of the indoor fan motor 117 to blow air in response to the control signal from the control means 104. Display means 118 indicates a selected operation mode (auto, cooling, heating, dehumidifying, blowing, etc.), room temperature and current time, all of which are input by the operation manipulating means 102.

Figure 7:
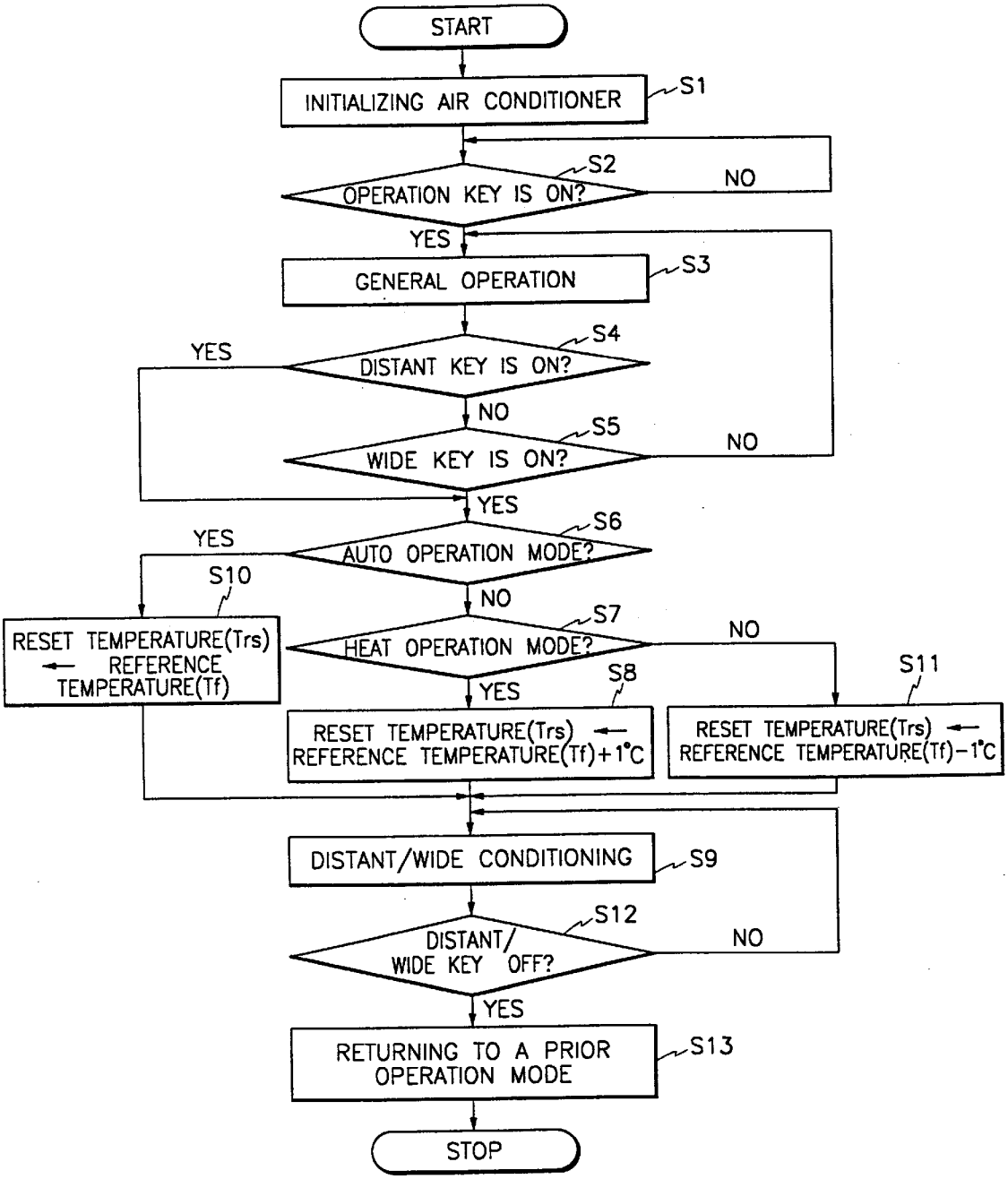
FIG. 7 is a flowchart for illustrating sequential procedures of an operation control apparatus of an air conditioner in accordance with the present invention.

Next, the operational procedures and effects of the operation control apparatus and the method thereof are described. FIG. 7 is a flowchart for illustrating the operational procedures of the operation control apparatus in accordance with the present invention, where S indicates each step. First of all, when a power is applied to the air conditioner, the power source means 100 serves to convert the commercial alternating current voltage supplied from the alternating current power terminal into a predetermined direct current voltage necessary for driving the air conditioner and then outputs same to respective driving circuit and control means 104.

At step S1, the direct current voltage from the power source means 100 is received by the controlling means 104 to initialize the operation of the air conditioner. At this time, a user selects an operation key on the input unit 103 or on the remote controller 9 to set: a desired operation mode (for instance, cooling or heating) of the air conditioner, a set or target room temperature (Ts), and an air speed and air flow direction, whereby the remotely controlled signal from the remote controller 9 is encoded by the predetermined protocol to be converted to an ultraviolet signal.

When the ultraviolet signal is sent from the remote controller 9 to the remotely controlled signal receiving unit 7, the ultraviolet signal is converted into an electrical signal which is later demodulated to operate the indoor unit 1.

At step S2, the control means 104 discriminates whether the operation key of the remote controller is turned on. If the operation key is not turned on (in case of NO), operations subsequent to step S2 are repeated with the air conditioner being maintained at an operation stand-by state.

As a result of the discrimination at step S2, if the operation key is turned on (in case of YES), flow advances to step S3, where the control means 104 determines an operation frequency of the compressor 109 depending on the difference between the set temperature (Ts) and the detected room temperature (Tr).

If the compressor 109 is driven, the room air sucked into the indoor unit 1 is heat-exchanged into cold or hot air at the heat-exchanger 15 by way of the evaporative latent heat of the coolant.

The heat-exchanged air is guided by the duct member 19 to pass through the vertical air blades 13 and the horizontal air blades 11 at the predetermined air flow angles, to thereby carry out the cooling or heating operation.

If one of the general operations of the air conditioner (auto, cooling, heating, dehumidifying, blowing) is turned on, it is determined at step S4 whether the distant conditioning is also turned on. If the distant conditioning key is not turned on (in case of NO), flow proceeds to step S5 to discriminate whether the wide conditioning key is turned on.

As a result of the discrimination at step S5, if the wide conditioning key is not turned on (in case of NO), flow returns to step S3 and operations subsequent to step S3 are repeated as the general operation of the air conditioner is being carried out. If either the distant key is turned on at step S4, or the wide conditioning key is turned on at step S5 (in case of YES), flow advances to step S6 to determine whether the operation mode is set at an auto operation.

As a result of the discrimination at step S6, if the air conditioner is not set at the auto operation mode (in case of NO), flow proceeds to step S7 to determine whether the air conditioner is set at the heating operation mode. If the air conditioner is set at the heating operation mode (in case of YES), flow proceeds to step S8 where the control means 104 resets the room temperature to a reset temperature (Trs) equal to a predetermined reference temperature (Tf) plus a predetermined increment I. The reference temperature (Tf) and the predetermined increment would be pre-programmed in the control means 104 at the time of manufacture of the air conditioner. For example, the reference temperature (Tf) could be 250° C., and the predetermined increment I could be 1° C. Thus, the reset temperature (Trs) would equal Tf+I, i.e. 25°+1°=26° C., regardless of the original set room temperature (Ts) originally selected by the user, and a corresponding signal is sent.

On the other hand, as a result of the discrimination at step S6, if the air conditioner is set at the auto operation mode (in case of YES), flow proceeds to step S10 where the control means 104 automatically resets the room temperature to the reference temperature (Tf) (i.e., Trs=Tf), and automatically selects a heating or cooling mode, depending upon the difference between the reference temperature (Tf) and the detected room temperature (Tr).

As a result of the discrimination at step S7, if the air conditioner is not set at the heating operation mode (in case of NO), it is assumed that a cooling mode is selected and flow proceeds to step S11 where the room temperature is reset to a reset temperature (Trs) which equals the reference temperature (e.g. 25° C.) minus a predetermined increment (e.g. 1° C.).

At step S9 the compressor is driven according to the difference between the detected room temperature Tr and the reset room temperature (Trs) (i.e., Tf+I during a heating mode; Tf−I during a cooling mode; Tf during an auto mode). At the same time, air flow directions of the vertical and horizontal air blades are controlled to direct air to the distant places of the room during the distant conditioning or to direct air across the width of the room during the wide conditioning.

While the distant or wide conditioning is carried out in the air conditioner it is determined at step S12 whether the distant or wide conditioning key has been turned off. If the distant or wide conditioning key has not been turned off (in case of NO), flow advances to step S9 and operations subsequent to step S9 are repeated. As a result of the discrimination at step S12, if the distant or wide conditioning key has been turned off (in case of YES), flow advances to step S13 to terminate the distant or wide conditioning and return the operation to a general operation mode occurring prior to the selection of the wide or distant mode.

There is an advantage in the operation control apparatus of the air conditioner and the method thereof in accordance with the present invention in that the room temperature is reset to a temperature of 1 degree Celsius higher or lower than a reference temperature (Tf) during the heating and cooling operations, respectively, as the distant or wide conditioning is being carried out. Thus, not only can a stronger cooling operation be carried out, but also a stronger heating operation can be carried out.

Although the present invention has been described in connection with a preferred embodiment thereof, it will be appreciated by those skilled in the art that additions deletions modifications and substitutions not specifically described may be made without departing from the spirit and scope of the invention as defined in the appended claims.

What is claimed is:

1. An operation control apparatus of an air conditioner comprising:

an air inlet for admitting air from a room;

a heat exchanger for selectively heating and cooling the admitted air;

an air outlet for discharging the heated air or cooled air;

a fan for sequentially circulating air through the inlet, the heat exchanger, and the outlet;

an adjustable air direction regulating mechanism for regulating a direction of air discharged from the outlet during modes of operation of the air conditioner including a distant mode wherein air is discharged to a distant region of the room and a wide mode wherein air is discharged across an entire width of a room;

an input device for enabling a user to select between the modes of operation, and for selecting a set room temperature; and a control mechanism connected to the heat exchanger, the fan, the input device, and the air direction regulating mechanism, the control mechanism being operable, in response to a selection of either the distant mode or the wide mode, to reset the room temperature to a reset temperature (Trs) equal to a reference temperature (Tf) raised by a predetermined increment during a heating mode and lowered by a predetermined increment during a cooling mode.

2. A method of operating an air conditioner which includes an air inlet, an air outlet, a heat exchanger, an air circulating fan and an air direction regulating mechanism at the air outlet, the method comprising the steps of:

A. selecting between a cooling operation and a heating operation; and between modes of operation including a distant mode wherein the air direction regulating mechanism is set to direct air to a distant region of the room, and a wide mode wherein the air direction regulating mechanism is set to direct air across an entire width of a room;

B. detecting a room temperature;

C. automatically establishing a reset temperature (Trs) in response to the distant mode or the wide mode being selected, wherein during a heating operation the reset temperature equals a reference temperature (Tf) raised by a predetermined increment, and during a cooling operation the reset temperature equals the reference temperature (Tf) minus a predetermined increment;

D. conducting room air across the heat exchanger to change the temperature of the room air in accordance with a difference between the reset temperature (Trs) and the detected room temperature (Tr); and E. discharging the room air back into the room through the air outlet until the detected room temperature (Tr) substantially corresponds to the reset temperature (Trs).

3. The method according to claim 2 wherein the predetermined increment by which the reference temperature (Tf) is raised during a heating operation equals the increment by which the reference temperature (Tf) is lowered during a cooling operation.

4. The method according to claim 3 wherein the predetermined increment is 1° C.

* * * * *